United States Patent [19]

Takada et al.

[11] Patent Number: 4,705,989

[45] Date of Patent: Nov. 10, 1987

[54] MAGNETRON WITH A CERAMIC STEM HAVING A CATHODE SUPPORT STRUCTURE

[75] Inventors: Kousuke Takada, Kawasaki; Akira Kousaka, Yokohama, both of Japan

[73] Assignee: Kabushiki Kaisha Toshiba, Kawasaki, Japan

[21] Appl. No.: 812,858

[22] Filed: Dec. 23, 1985

[30] Foreign Application Priority Data

Dec. 28, 1984 [JP] Japan ..... 59-274721

[51] Int. Cl.[4] ..... H01J 25/50

[52] U.S. Cl. ..... 315/39.51; 315/39.53; 315/39.55; 315/39.63; 315/39.75; 315/39.77; 313/341

[58] Field of Search ..... 315/39.51, 39.53, 39.55, 315/39.63, 39.97, 39.75; 313/341

[56] References Cited

U.S. PATENT DOCUMENTS

| | | | |
|---|---|---|---|
| 4,042,851 | 8/1977 | Yasuoka et al. | 315/39.51 |
| 4,048,542 | 9/1977 | Miura | 315/39.51 |
| 4,066,928 | 1/1978 | Van Besouw et al. | 315/39.51 |
| 4,105,913 | 8/1978 | Yamano et al. | 315/39.51 |
| 4,109,179 | 8/1978 | McKinnon | 315/39.51 |
| 4,163,175 | 7/1979 | Tashiro | 315/39.51 |

FOREIGN PATENT DOCUMENTS

| | | |
|---|---|---|
| 5629864 | 8/1979 | Japan . |
| 56-132747 | 3/1980 | Japan . |

*Primary Examiner*—David K. Moore
*Assistant Examiner*—Michael J. Nickerson
*Attorney, Agent, or Firm*—Oblon, Fisher, Spivak, McClelland & Maier

[57] ABSTRACT

A magnetron comprises a ceramic stem having a cathode support structure. Sealing metal plates are sealed hermetically to the cathode side of the ceramic stem, closing off hermetically the holes running through the stem for the outer connecting leads. The outer connecting leads are connected electrically to the sealing metal plates. The cathode, which is disposed in the center of the anode, is supported by a pair of cathode support rods. The cathode support rods are fixed to the sealing metal plates. In another embodiment, the end-face of the ceramic stem is formed such that the part of the surface of the stem to which the cylindrical metal container, which constitutes part of the envelope of the stem, is sealed by brazing, and those parts of the surface to which the sealing metal plates are sealed by brazing, are positioned substantially on the same plane.

14 Claims, 18 Drawing Figures

MAGNETRON WITH A CERAMIC STEM HAVING A CATHODE SUPPORT STRUCTURE

BACKGROUND OF THE INVENTION

1. Field of the Invention

This invention relates to a magnetron, more particularly to an improvement in its cathode support structure.

2. Background of the Prior Art

In the cathode support structure of the conventional magnetron for use in microwave ovens, as illustrated in FIG. 17, the two ends of the filament cathode 21 which is coiled are fixed to a pair of end caps 22, 23, either directly or via a guide 24. A pair of cathode support rods 25, 26, made of molybdenum, are fixed to the two end caps 22, 23. These cathode support rods 25, 26 pass to the outside via throughholes 28 which run right through the ceramic stem 27, and are bonded hermetically to terminal strips 29, which are brazed hermetically at the outer ends. 30 indicates the brazed connections. A metal sleeve 31, which forms part of the evacuated envelope, is sealed hermetically at a brazed joint 32 to the top of the ceramic stem.

In this kind of conventional structure, the molybdenum cathode support rods have to be fairly long, as they are sealed hermetically at the bottom end of the stem and extend outside it. This makes these parts expensive, and in addition it is not easy to obtain by this means sufficiently rigid support for the cathode. Further, it is difficult to achieve a hermetic seal between molybdenum and Kovar (trade name) (Fe-Ni-Co alloy) and since the hermetic joint is subjected to high temperatures because of heat conducted from the cathode, it is difficult to ensure a high degree of reliability for this seal.

A different structure, that shown in FIG. 18, has been proposed in, for example, disclosed Japanese Patent Application Laid-open No. 56-132747. In this structure, hermetic sealing of the ceramic stem 27 and the cathode support rods 25, 26 is obtained by hermetic brazing using sealing rings 33 on the cathode side, i.e., on the side facing the evacuated region, of the stem. In this case, the provision of a step between the brazed joint 32 of the stem and the metal sleeve and the brazed joint 30 of the stem and the cathode support rods enhances withstand-voltage performance between the two. But this structure too has disadvantages: here again the molybdenum cathode support rods have to be long, so that the cost of these parts remains high, and overheating of the brazed joints of the cathode support rods is still likely to impair the seal. There is the additional disadvantage in both types of structure that since the hermetic brazed connections of the ceramic stem to the cathode support rods and to the metal sleeve are displaced relative to each other in the axial direction of the tube, the process of forming the metallized layer for these brazed joints is complicated.

SUMMARY OF THE INVENTION

It is one object of the invention to provide a magnetron in which the cathode support rods are as short as possible, and a high degree of reliability can be obtained for the hermetic seals with the ceramic stem.

The invention comprises a magnetron for use in microwave ovens, wherein sealing metal plates are sealed hermetically to the cathode side of the ceramic stem, i.e., to that side which faces the evacuated region, outer connecting leads are inserted through holes formed in the stem, these leads being connected electrically to the sealing metal plates, cathode support rods are fixed to part of a sealing metal plate in each case, and the cathode support rods and outer connecting leads are thereby connected electrically via the sealing metal plates.

With this structure, it is sufficient for the cathode support rods to be of a length corresponding approximately to the distance from the position of the cathode to the inner face, i.e., the cathode side, of the ceramic stem, and the cost of these parts is thereby reduced. Further, since heat conducted from the cathode does not pass directly to the outer connecting leads, overheating of the hermetic seals between the ceramic stem and the sealing metal plates is minimized, and the reliability of these seal is thus increased.

Moreover, since the hermetic seals between the ceramic stem and the sealing metal plates and between the ceramic stem and the metal sleeve are positioned substantially on the same plane, the metallized layer required for all these seals can be formed in a single process, which simplifies the assembly procedure.

DETAILED DESCRIPTION OF THE PREFERRED EMBODIMENT

Figure 1:
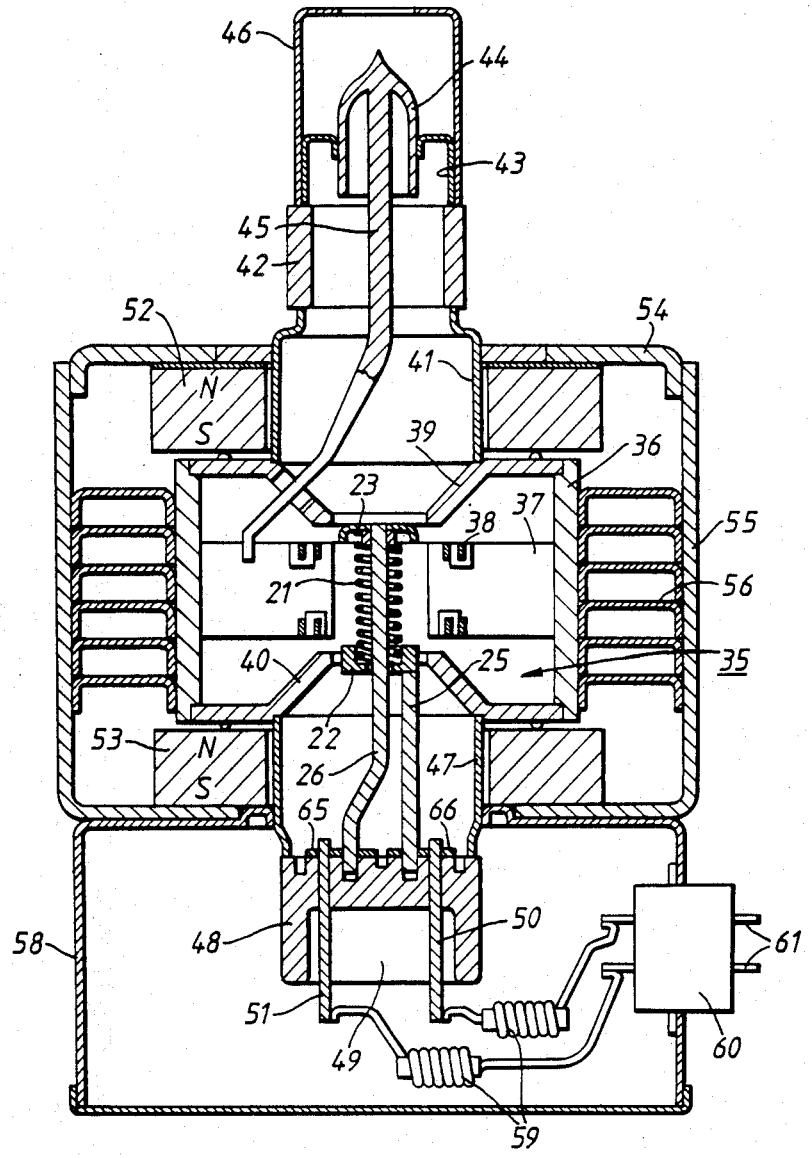
FIG. 1 is a longitudinal section of one embodiment of the invention.

An explanation follows of the embodiment, referring to the drawings. The corresponding parts are designated by the same numbers throughout.

The embodiment as shown in FIGS. 1–8 has the structure described below. The numbers used in FIG. 1 refer to the following parts.

The coiled filament cathode 21 has two ends fixed to a pair of end caps 22, 23 on the axis of an anode 36. A pair of cathode support rods 25, 26, made of molybdenum, are fixed to the two end caps 22, 23. These cathode support rods 25, 26 are supported with a ceramic stem 48.

The anode structure 35 has cylindrical anode 36 which forms part of the tube envelope, and is provided on its inside wall with radially disposed vanes 37 which divide the interior of the cylinder into a plurality of resonators. The vanes 37 are all interconnected by a circular strap ring 38. A pair of pole pieces 39, 40 for concentrating the magnetic field into the electron flow region are brazed to the two end-faces of the cylindrical anode 36. An output side metal sleeve 41 which forms part of the outer envelope of the tube is mounted on the output side pole piece 39; on the top of this metal sleeve 41 are mounted an output part ceramic cylinder 42, a sealing ring 43 forming part of a high frequency choke, and a metal exhaust tube 44, also forming part of the high frequency choke. An output antenna lead 45 extends between one of vanes 37 and metal exhaust tube 44, to extract the microwave power produced by the resonators outside the tube. Part 46 is an output cap.

On the cathode support side of the anode structure, a cylindrical metal sleeve 47 extends from ceramic stem side pole piece 40. This cylindrical sleeve 47 forms part of the evacuated envelope, and therefore one end-face is hermetically sealed to pole piece 40, while the other end-face is hermetically sealed to ceramic stem 48. A recess 49 is formed in the bottom of ceramic stem 48, and a pair of outer connecting leads 50, 51 project from this recess 49. A pair of ferrite permanent magnets 52, 53 are incorporated, with the above-mentioned pole pieces between them, into the main body of the magnetron having this structure; open-frame yokes 54, 55 of ferromagnetic material are disposed outside these magnets.

A perforated metal gasket is fixed between output side metal sleeve 41 and yoke 54, and radiator fins 56 are provided around cylindrical anode 36.

Ceramic stem 48 and outer connecting leads 50,51 are enclosed in a closed box 58; this closed box also contains filter conductors 59. Outer connecting leads 50,51 are connected, via the inductors 59, to a feed-through capacitor 60, which together with these inductors constitutes the filter, and to cathode input terminals 61.

The structure of the parts of the ceramic stem 48 is shown in FIGS. 4–7. In general, this ceramic stem is a cylinder closed at one end. In longitudinal section it forms an inverted U-shape. One end face (the upper end-face in the drawings) has an annular groove 71 formed on it. The surface of the stem bounded by the annular groove 71 serves as the semicircular surfaces P to which are brazed the sealing metal plates (there are two such surfaces, one on the left and one on the right), while the surface of the stem outside the annular groove 71 serves as a surface Q to which is brazed the metal sleeve. Both these sealing surfaces P and Q are formed so that they are positioned on the same plane, at right angles to the central axis. On the other side (the underside) of the ceramic stem, an air side recess 49 is formed, with a large central area hollowed out in the axial direction. Two through-holes 67, 68 are provided in the stem; and two recesses 69, 70 of a prescribed depth, for taking the ends of the cathode support rods, are provided in diagonally opposed positions adjacent to through-holes 67, 68. A groove 72 is formed (across the end-face of the stem) which separates one through-hole 67 and its associated recess 69 for taking the end of one support rod from the other through-hole 69 and its associated recess 70 for taking the end of the other support rod.

Figure 8:
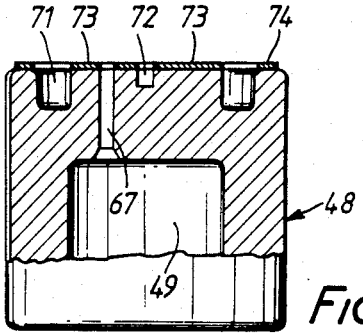
FIG. 8 is a partial longitudinal section, showing the ceramic stem and metallized layers of the embodiment illustrated in FIG. 1.

Next, using the ceramic stem formed in this way, a molybdenum-manganese paste is applied over the whole of the metal plate sealing surfaces P and the metal sleeve sealing surface Q, which are positioned on the same plane, as shown in FIG. 8. Taking advantage of the fact that the sealing surfaces P and Q are on the same plane, and that there are no projections or obstacles of any kind between these sealing surfaces, the paste can be applied, for example, by the screen process. After the paste has dried, the stem is placed in a furnace filled with an inert gas and heated to a temperature of about 1400° C. and sintered, so that metallized layers 73, 74 are formed.

Figure 2:
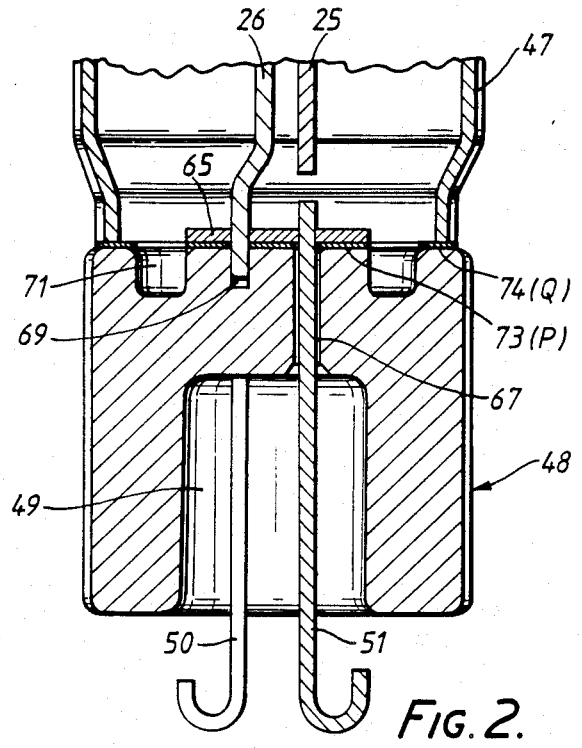
FIG. 2 is a longitudinal section showing in enlarged form the principal part of FIG. 1.
Figure 3:
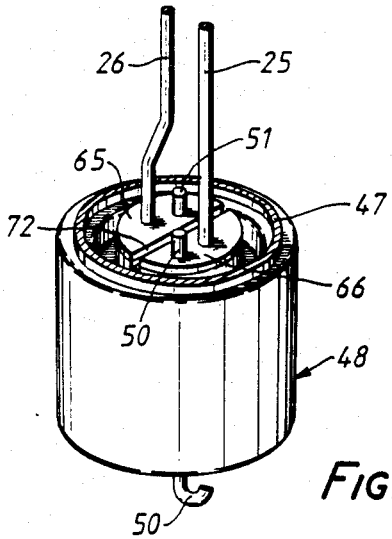
FIG. 3 is an oblique view of the principal part of FIG. 2.
Figure 4:
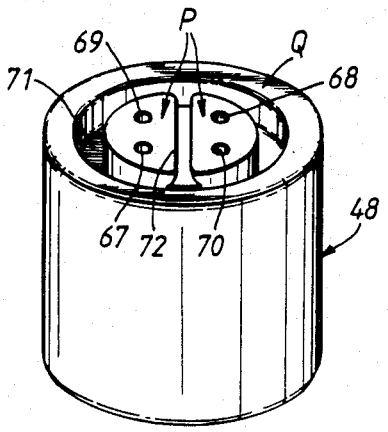
FIG. 4 is an oblique view of the ceramic stem of the embodiment illustrated in FIG. 1.
Figure 5:
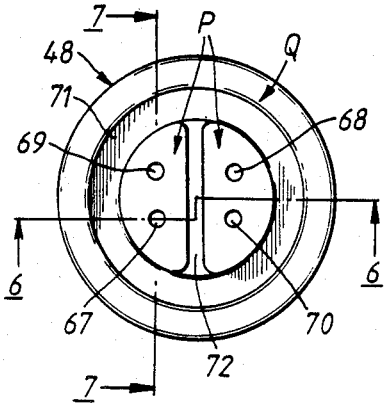
FIG. 5 is a plan view of FIG. 4.
Figure 6:
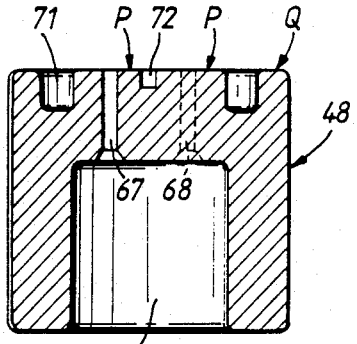
FIG. 6 is a longitudinal section along the line 6—6 in FIG. 5.
Figure 7:
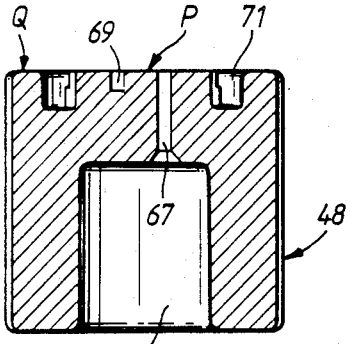
FIG. 7 is a longitudinal section along the line 7—7 in FIG. 5.

Next, sealing metal plates 65, 66 and metal sleeve 47 are hermetically brazed with silver solder to the corresponding sealing surfaces P and Q, as illustrated in FIGS. 2 and 3. The outer connecting laads 50, 51, of a metal such as copper or iron, are passed through the stem and inserted into the holes formed in sealing plates 65, 66, and hermetically sealed by brazing at the holes. These leads extend through holes 67, 68, beyond recess 49, to permit external connections to be made. The ends of cathode support rods 25, 26 are likewise fitted into the adjacent holes formed in two sealing metal plates 65, 66, and bonded by brazing; the bottom ends of these rods, which extend below the sealing metal plates, engage in recesses 69, 70 of a prescribed depth formed in the stem, the rods being stabilized mechanically, and their position fixed, by this means. The materials used for these sealing metal plates 65, 66 are metals such as Kovar (trade name) or Fe-Ni-Cr alloys, which have a similar thermal expansion coefficient to that of the ceramic stem, and which are easy to braze via metallized layer 73. Thus cathode support rods, 25, 26 and outer connecting leads 50, 51 are connected electrically via sealing metal plates 65, 66. The joints between cathode support rods 25, 26 and sealing metal plates 65, 66 provide electrical connections only, and play no part in the hermetic sealing of the ceramic stem, while the joints between the sealing metal plates and the outer connecting leads are hermetically sealed at the through-holes of the stem. The open end of metal sleeve 47 which forms part of the evacuated envelope is joined, also by brazing, to metallized layer 74 at the circumference of the surface of the ceramic stem. Annular groove 71, on the inner end-face of the stem, which is within the evacuated region of the tube, is formed in such a way that the creepage distance and clearance are sufficient to provide electrical isolation between the sealing plates, which are made at the same potential as the cathode, and the metal sleeve, which is made at the same potential as the anode structure, at the high voltage that is applied during the working of the magnetron. As these isolation distances are within a vacuum, it is sufficient for them to be relatively short. Furthermore, diametral groove 72 guarantees the electrical isolation from each other of the two sealing metal plates to which the filament heating voltage is applied. Again, central recess 49 on the air side is so formed that the creepage distance is sufficient to provide electrical isolation in the air, at the high voltage that is applied, between the anode structure, including the metal sleeve, and the outer connecting leads.

In this embodiment of the invention, the molybdenum cathode support rods can be shortened, since it is sufficient for them to extend from the end caps to the inside of the ceramic stem; and the cost of these parts can thereby be reduced. Further, since the brazing of the cathode support rods to the sealing metal plates has no direct connection with the hermetic seal, there is no need to apply Ni plating or the like to the surface of the cathode support rods. Also, since the vacuum hermetic seal is obtained by brazing between the sealing metal plates and outer connecting leads and the metallized layer on the ceramic stem, materials with are easy to braze to ceramic can be used for the sealing metal plates, and a hermetic seal of a high degree of reliability is obtained. Moreover, since the heat conducted from the cathode and passing down the molybdenum cathode support rods does not pass directly into the parts where the ceramic and the sealing metal plates are hermetically brazed, in this respect also the risk of any failure of the hermetic seal is reduced. Again, even when an outside force is applied to the outer connecting leads, this force will not impinge directly upon the cathode, so that there is little risk of the cathode being deformed or broken. Further, since the brazed surfaces of the ceramic stem are positioned on the same plane, the metallized layers can be formed in a single process, which simplifies manufacture.

Figure 9:
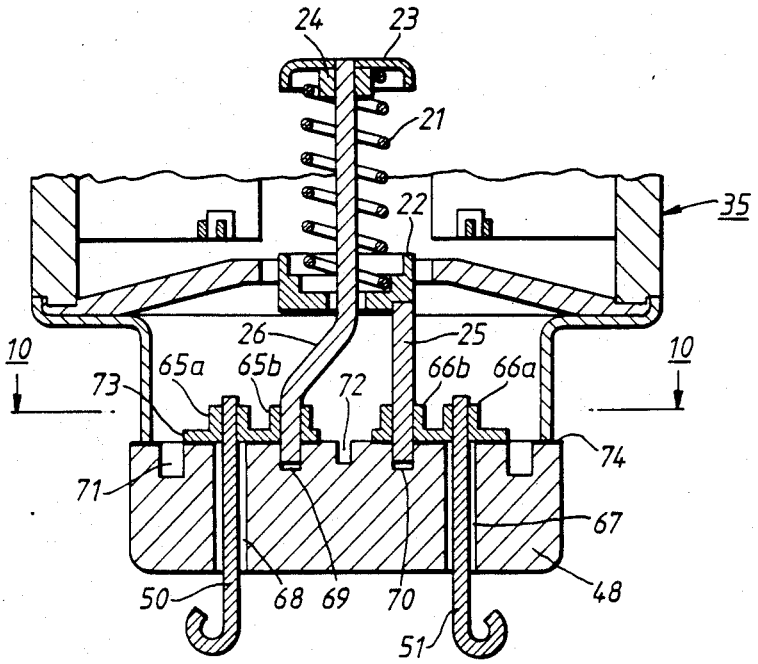
FIG. 9 is a longitudinal section of the principal part of another embodiment of the invention.
Figure 10:
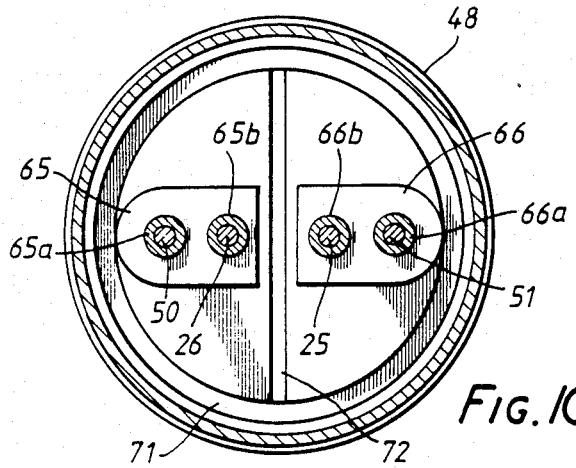
FIG. 10 is a cross section along the line 10—10 in FIG. 9.

The embodiment depicted in FIGS. 9 and 10 has a ceramic stem 48 shape like a thick disc. Sealing metal plates 65, 66, each having two integrally formed adjacent eyelets 65*a* 65*b*, 66*a*, 66*b*, are brazed to the cathode side (i.e., the evacuated region side) of the ceramic stem; the cathode support rods 25, 26 and outer connecting leads 50, 51 are brazed to these eyelets. The metal sleeve 47 is hermetically brazed at the circumference of the surface of the stem on the same plane as these seals. Since cathode support rods 25, 26 not only fit tightly into the eyelets of the sealing metal plates, but have their bottom ends fitted into recesses 69, 70 in the stem, a further degree of mechanical stability and of accuracy in their positioning is obtained. As the outer connecting leads also are inserted into separate eyelets and brazed to them, an even more reliable hermetic seal is achieved.

Moreover, although in the embodiments described above, the provision made in the structure for joining the sealing metal plates to the outer connecting leads consists of holes or eyelets with holes, formed in or on the sealing metal plates, into which the ends of the outer connecting leads are inserted, and then brazed to achieve hermetic sealing, the structure need not be limited to this arrangement. The outer connecting leads may, for example, be hermetically brazed to the surface of the ceramic stem at the upper rims of the through-holes, without any holes being formed in the sealing metal plates to take these leads, which are then connected electrically by brazing or welding to the stem through-hole side of the sealing metal plates. If this structure is adopted, the connection between the sealing metal plates and the outer connecting leads plays no part in the achievement of a hermetic seal, and reliability is further increased thereby. In this case, recesses can be formed in the sealing metal plates from the air side, and the outer connecting leads can then be connected by inserting them into these recesses.

The invention may also be so constructed that the structures described above are applied to at least one of a plurality of cathode support rods.

Figure 11:
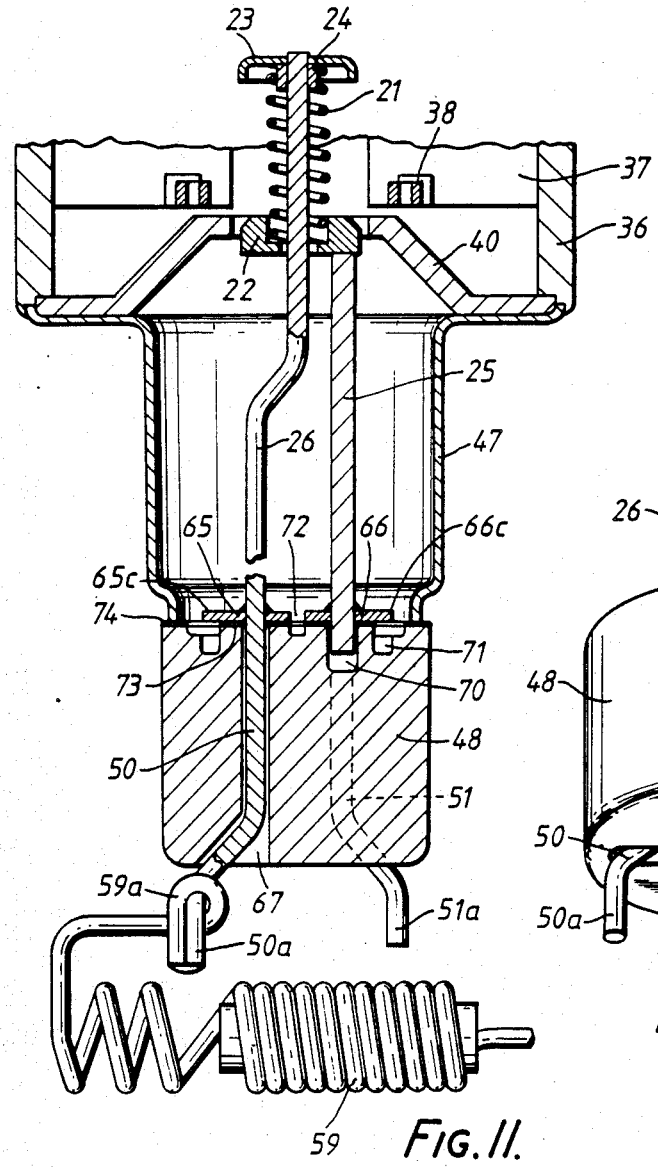
FIG. 11 is a longitudinal section of the principal part of another embodiment of the invention.
Figure 12:
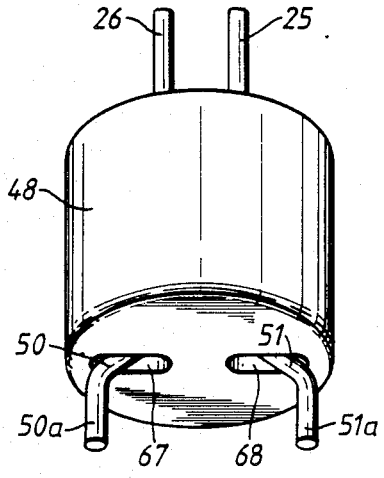
FIG. 12 is an oblique view of the principal part of FIG. 11.

FIGS. 11 and 12 show another embodiment of the invention.

If the parts where the sealing metal plates and the metal sleeve are hermetically brazed to the ceramic stem are positioned substantially on the seam plane, the clearance between the two brazed parts is reduced, and also, since the edges of these brazed parts form a rough surface, electrical discharge is more likely to occur between the two. In a microwave oven, in particular, when the power is switched on without any preheating of the filament cathode, an abnormally high voltage is applied to the magnetron, and electrical discharge is likely to occur between the above-mentioned two brazed parts. Also, the phenomenon may occur whereby some of the electrons emitted from the filament cathode pass through the gap between the end caps and the pole pieces to reach the ceramic stem in the form of stray electrons. These stray electrons bombard the inner surface of the annular groove in the ceramic stem, causing secondary electrons to be emitted from the ceramic and electrically charging this ceramic surface. This can result in an electrical discharge being produced between the charged surface of the ceramic groove and the sealing metal plates or the part where they are brazed.

To prevent these kinds of electrical discharge from occurring within the tube, the structure of the embodiment depicted in FIGS. 11 and 12 is desirable. In this embodiment, the outer edges 65*c*, 66*c* of the sealing metal plates 65, 66 which are brazed to the inner side of the ceramic stem 48 are extended over the annular groove 71.

Figure 13:
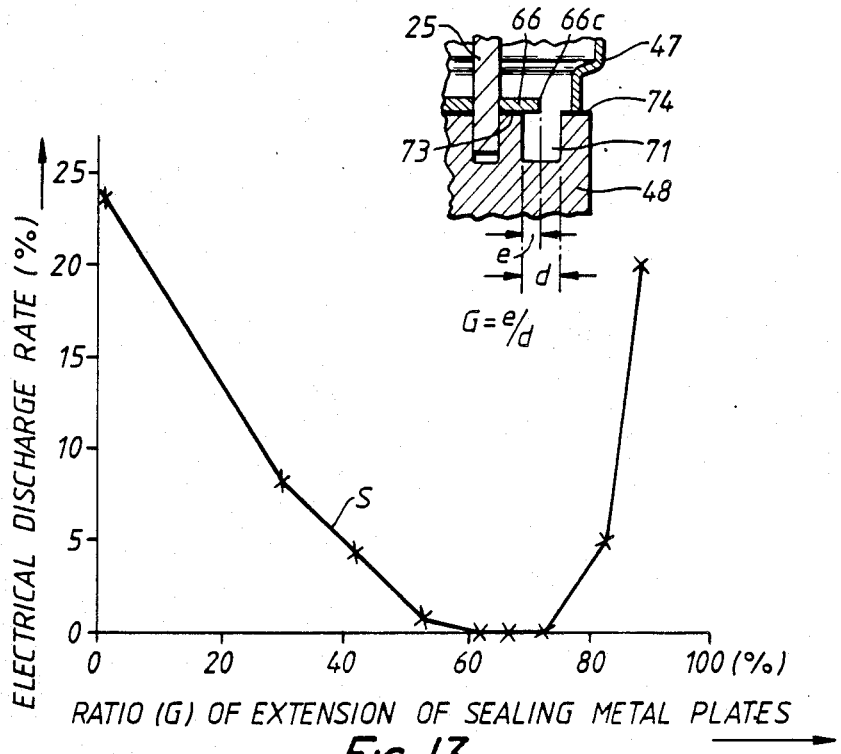
FIG. 13 explains the embodiment depicted in FIG. 11; it is a graph showing the relation between the extension ratio G of the sealing metal plates and the rate of occurrence of electrical discharge.

The present inventors confirmed, by varying the ratio G of the length of the extension e (from the brazed part 73 out over the groove) to the dimension (width) d of the annular groove 71 in the radial direction ($G=e/d$), the existence of a relation between it and the rate of electrical discharge within the tube. The results they obtained are shown in FIG. 13. The horizontal axis of the graph represents the ratio G of the extension of the sealing metal plates to the dimension (width) of the groove; the vertical axis, the electrical discharge rate. This electrical discharge rate is the percentage of occasions on which an electrical discharge occurred when microwave ovens fitted with various test magnetrons were each switched ON/OFF 20 times, with no preheating of the filament cathode. As is clear from the line S joining the test points indicated by X, electrical discharge in the vicinity of the annular groove in the stem could be prevented with virtual certainty with an extension ratio G of approximately 50–70%. It is desirable, therefore, that the outer edges 65*c*, 66*c* of the sealing metal plates should be extended to about the middle of the annular groove.

Moreover, in this embodiment, the through-holes 67, 68 are each progressively elongated outwards in the lowest part of the ceramic stem so that they emerge as slots at the lower end-face of the stem; the ends 50*a*, 51*a* of the outer connecting leads 50, 51 are bent outwards to the shape of an inverted V, following the shape of the outer walls so that they emerge from the lower end-face of the ceramic stem at the outer ends of the slots. This ensures that no undesired rotation of the leads occurs during assembly. A lead 59*a* from an inductor 59 is wound round the end of each outer connecting lead and welded to it, forming an electrical connection.

Figure 14:
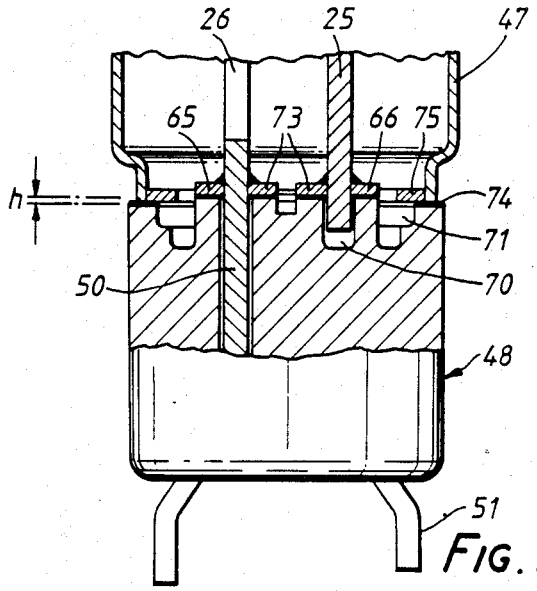
FIG. 14 is a partial longitudinal section of the principal part of another embodiment of the invention.

In the embodiment illustrated in FIG. 14, the construction is such that the brazed part 74 where the metal sleeve is brazed to the stem is displaced, in relation to the hermetically brazed parts 73 of the sealing metal plates 65, 66, by a small amount h in the axial direction of the tube, towards the bottom of the annular groove 71. As the amount h of this displacement is not more than 1 mm, the application of the metallized layer to the surfaces to be brazed can be effected at one and the same time in a single process, this case being equivalent to that when the two surfaces to be brazed are substantially on the same plane. A shield ring 75, made of electrically conductive material, for preventing electrical discharge, is fixed by brazing to the brazed part 74 provided for brazing the metal sleeve 47. The inner flange of this shield ring 75 extends about midway over the annular groove 71.

Alternatively, even if the two surfaces are on the same plane, the shield ring 75 may be fixed, and in case that the amount h of the displacement is 1 mm or more, desirably 1 mm to 3 mm, the ring will not necessarily be needed, according to circumstances.

By this means, electrical discharge in the vicinity of the annular groove is prevented.

Figure 15:
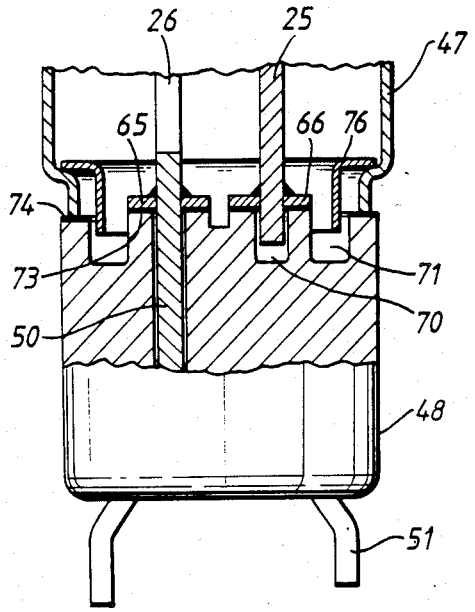
FIG. 15 is a partial longitudinal section of the principal part of another embodiment of the invention.

In the embodiment illustrated in FIG. 15, a shield ring 76 having a short tubular part is fixed to the inside of the metal sleeve 47, and a similar effect to the above, namely the prevention of electrical discharge, is obtained by inserting the end of this short tubular part of the shield ring 76 into the annular groove 71.

Figure 16:
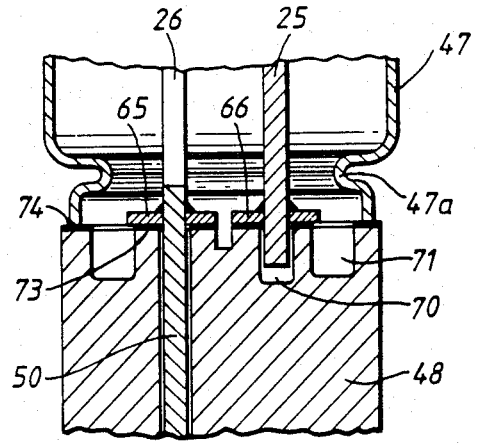
FIG. 16 is a longitudinal section of the principal part of another embodiment of the invention.
Figure 17:
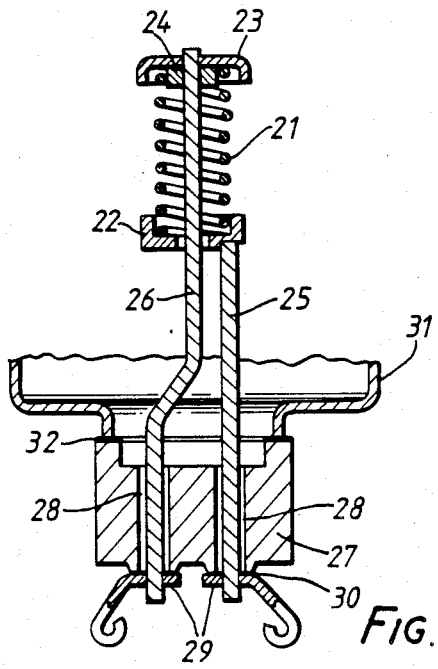
FIG. 17. (PRIOR ART)
FIG. 17 is a longitudinal section showing the principal part of a conventional structure.
Figure 18:
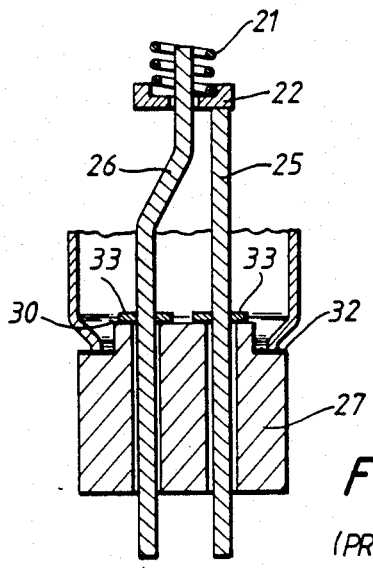
FIG. 18. (PRIOR ART)
FIG. 18 is a longitudinal section showing another example of a conventional structure.

In the embodiment illustrated in FIG. 16, a buckled shield part 47*a* is formed by buckling the wall of the metal sleeve 47 inward near its lower end to produce an internal ripple. The size of this buckled shield part 47*a* is such that it occludes the annular groove 71. Also, the outer edges of the sealing metal plates 65, 66 project slightly over the groove 71. Electrical discharge is prevented by this means.

Other variations can be made in the structure for achieving a similar effect, i.e., the prevention of electrical discharge.

As explained above, this invention provides the magnetron with a ceramic stem having a cathode support structure that sealing metal plates are hermetically sealed on to the cathode side end-face of the ceramic stem, i.e., on to the surface of the stem which faces the evacuated region; outer connecting leads are inserted through holes formed in the stem, and these leads are connected electrically to the sealing metal plates; and cathode support rods are fixed to part of a sealing plate in each case, these cathode support rods and the outer connecting leads being connected electrically via the sealing metal plates. With this structure, the cathode support rods need only be of a length corresponding approximately to the distance from the cathode to the inner end-face of the ceramic stem, i.e., that side facing the cathode; with the result that the cost of these parts is reduced. Further, the fact that the cathode support rods can be shortened means that they are more resistant to vibration, and the risk of the filament breaking is thereby reduced. Again, since the heat conducted from the cathode is not transmitted directly to the outer connecting leads, overheating of the hermetic seals between the ceramic stem and the sealing metal plates is minimized, so that the hermetic sealing is highly reliable.

Furthermore, if the hermetic seals of the ceramic stem and the sealing metal plates and that of the ceramic stem and the metal sleeve are positioned on the same plane, formation of the metallized layer for the brazing in each case can be carried out in a single process, which not only facilitates assembly but also makes it possible to automate the process, and thereby facilitates the potentiality for mass production of magnetrons for use in microwave ovens.

We claim:

1. A magnetron comprising:

a cylindrical anode with a plurality of vanes;

a cylindrical metal sleeve forming part of an evacuated envelope having one open end hermetically sealed to said cylindrical anode;

a cathode positioned coaxially withing said anode;

a pair of cathode support rods supporting said cathode;

a ceramic stem provided with through-holes and hermetically sealed to the other open end of said cylindrical metal sleeve;

outer connecting leads extending through the through-hoes of said ceramic stem to the cathode side of said ceramic stem; and sealing metal plates fixed to the cathode side of said ceramic stem and comprising means for hermetically sealing said through-holes, for electrically connecting said outer connecting leads at the through-hole sealing positions, for supporting said cathode support rods at positions adjacent to the sealed positions of the through-holes on the cathode side of said ceramic stem, and for electrically connecting said cathode support rods to said outer connecting leads.

2. A magnetron according to claim 1 wherein said ceramic stem has holes on its cathode side into which said cathode support rods are inserted and are thereby held in position.

3. A magnetron according to claim 1 wherein said cathode support rods are of molybdenum, and said sealing metal plates and outer connecting leads are of Fe or an Fe alloy.

4. A magnetron comprising:

a cylindrical anode with a plurality of resonators;

a metal cylinder with one of its open ends hermetically sealed to one end-face of said anode;

a cathode positioned coaxially with said anode;

a pair of cathode support rods supporting said cathode;

a ceramic stem holding said cathode support rods and hermetically sealed to the other open end of said metal cylinder, wherein said ceramic stem has through-holes;

outer connecting leads extending through the through-holes to the cathode side of said ceramic stem;

sealing metal plates brazed to the cathode side of said ceramic stem, said sealing metal plates hermetically sealing said through-holes and being electrically connected to said outer connecting leads at the positions of the through-holes, and said sealing metal plates holding and being electrically connected to said cathode support rods at positions different from the through-holes for electrical connection of said outer connecting leads and said cathode support rods; and said ceramic stem including a first surface where said metal cylinder is to be brazed and second surfaces where said sealing metal plates are to be brazed, the first and second surfaces being positioned on the same plane.

5. A magnetron according to claim 4 including wherein a groove formed on the cathode side of said ceramic stem, between that part of the surface to which said metal cylinder is hermetically sealed and those parts of the surface on which said sealing metal plates are positioned.

6. A magnetron according to claim 5 wherein said groove is in the shape of a ring positioned within the hermetic seal with said metal cylinder.

7. A magnetron according to claim 5 wherein the outer edges of said sealing metal plates extend from the edge of the brazed surface of said ceramic stem at the edge of said groove to about midway over said groove.

8. A magnetron according to claim 6 wherein a flange or ring comprising an electron shield is extended inwards from the metal cylinder, said flange or ring projecting from the hermetic seal to the mid-point of said groove of said ceraminc stem.

9. A magnetron according to claim 4 wherein said sealing metal plates are semicircular.

10. A magnetron according to claim 1 wherein said cathode is the directly-heated type, in coil form, and two cathode support rods support the two ends of said cathode respectively.

11. A magnetron according to claim 10 wherein the first cathode support rod is extended in a straight line axially through the center of said coil-shaped cathode to the stem side, the second cathode support rod is extended, parallel to the first cathode support rod and at a predetermined distance therefrom, to the stem side, said two sealing metal plates are electrically connected respectively to said cathode support rods at the stem, the two outer connecting leads are connected respectively to said sealing metal plates and pass through the stem to the outside, and the clearance between said outer connecting leads is set to be larger than the clearance between said cathode support rods.

12. A magnetron according to claim 10 wherein the diameter of the first cathode support rod is larger than the diameter of the second cathode support rod.

13. A magnetron comprising:

an anode;

a cathode positioned in the center of said anode;

cathode support rods extending from said cathode;

a ceramic stem integrally sealed via metal parts to said anode and supporting said cathode support rods; and outer connecting leads extending from said ceramic stem;

wherein said ceramic stem includes a block having at least two holes passing through said block and elongated in the radial direction of said block, the holes further having a degree of elongation increasing from the cathode side to the outside of said block, sealing metal plates fixed to the cathode side of said block, said sealing metal plates hermetically sealing the holes and supporting, and being electrically connected to, said cathode support rods at positions adjacent to the hole seals, said outer connecting leads extending through the holes and electrically connected to said sealing metal plates at the positions of the hole seals, and said outer connecting leads being bent along the direction of increasing elongation of the holes.

14. A magnetron according to claim 1 including eyelets provided in said sealing metal plates into which said cathode support rods are inserted.

* * * * *